US009789348B1

(12) United States Patent
Krull et al.

(10) Patent No.: US 9,789,348 B1
(45) Date of Patent: Oct. 17, 2017

(54) HAND-HELD EXERCISE WEIGHTS

(71) Applicants: Mark A. Krull, New Braunfels, TX (US); Darrin M. Swagel, St. Louis Park, MN (US)

(72) Inventors: Mark A. Krull, New Braunfels, TX (US); Darrin M. Swagel, St. Louis Park, MN (US)

( * ) Notice: Subject to any disclaimer, the term of this patent is extended or adjusted under 35 U.S.C. 154(b) by 0 days.

(21) Appl. No.: 14/260,936

(22) Filed: Apr. 24, 2014

(51) Int. Cl.
*A63B 21/06* (2006.01)
*A63B 23/12* (2006.01)

(52) U.S. Cl.
CPC ..... *A63B 21/06* (2013.01); *A63B 21/0601* (2013.01); *A63B 21/0604* (2013.01); *A63B 23/12* (2013.01)

(58) Field of Classification Search
CPC . A63B 21/06; A63B 21/0601; A63B 21/0604; A63B 21/072; A63B 23/16; A63B 23/1281; A63B 23/14
See application file for complete search history.

(56) References Cited

U.S. PATENT DOCUMENTS 2,633,358 A * 3/1953 Wright ..... A63B 23/16 482/49
3,814,288 A * 6/1974 Westrich ..... A45F 3/16 215/13.1
4,703,927 A * 11/1987 Hanzlik ..... A45F 3/16 215/6
4,891,900 A 1/1990 Snyder
4,898,380 A * 2/1990 Kobrin ..... A63B 21/0023 482/93
D311,640 S * 10/1990 Grengs ..... D3/260
4,973,043 A * 11/1990 Nolan ..... A63B 23/03533 482/106
5,188,266 A * 2/1993 Loulias ..... B65D 81/3876 224/148.2
5,309,666 A 5/1994 Prince
5,450,689 A 9/1995 Glick
D466,582 S 12/2002 Haney
D498,813 S 11/2004 Nichols
D576,592 S * 9/2008 Hsu ..... D14/138 AB
D595,387 S 6/2009 Harrison
D598,972 S 8/2009 Voss
D615,605 S 5/2010 Frasco et al.
(Continued)

*Primary Examiner* — Loan H Thanh
*Assistant Examiner* — Megan Anderson

(57) ABSTRACT

A hand-held exercise weight has first and second segments that are integrally interconnected to one another at a juncture in a manner that defines an acute angle between the two segments. The resulting configuration may be described as a j-shaped weight or a check-mark-shaped weight or an asymmetrical V-shaped weight, with an inside corner filleted by a first rounded curve and an outside corner filleted by a relatively larger, second rounded curve. The second segment is configured and arranged to alternatively comfortably overlie a person's forefinger when the first segment is comfortably grasped in a first orientation by all four fingers; comfortably overlie outwardly facing skin extending between a person's thumb and forefinger when the first segment is comfortably grasped in a second orientation by at least the three fingers furthest from the person's thumb; and fit comfortably between a person's forefinger and middle finger when the first segment is comfortably grasped by the three fingers furthest from the person's thumb.

11 Claims, 11 Drawing Sheets

(56) References Cited

U.S. PATENT DOCUMENTS

| | | | | |
|---|---|---|---|---|
| 7,739,910 | B2 * | 6/2010 | Clem | A63B 21/0004<br>73/379.02 |
| 2008/0268278 | A1 * | 10/2008 | Walsh | A63B 21/06<br>428/600 |

* cited by examiner

Fig. 10d
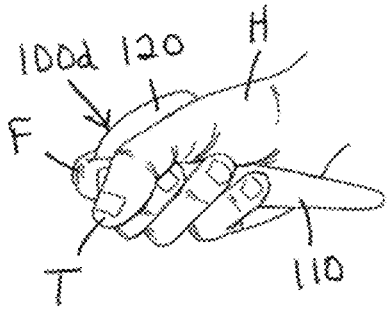
Fig. 10e
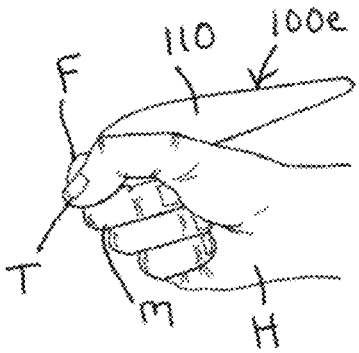
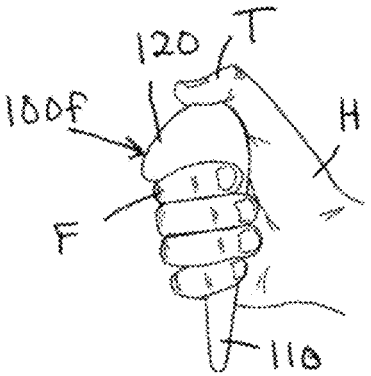
Fig. 10f
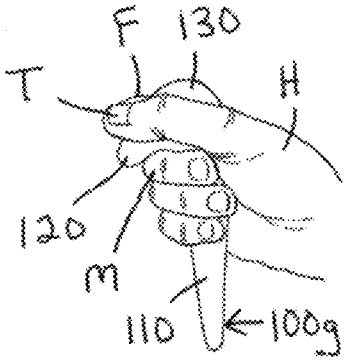
Fig. 10g

HAND-HELD EXERCISE WEIGHTS

FIELD OF THE INVENTION

The present invention relates to weights and in a preferred application, to hand-held exercise weights.

BACKGROUND OF THE INVENTION

Past efforts have led to various inventions directed toward exercise equipment, yet room for continued improvement remains. An object of the present invention is to provide new and useful hand-weights that are affordable and effective.

SUMMARY OF THE INVENTION

The present invention may be described in terms of embodiments, features and parameters for the manufacture and use of free weights that fit comfortably in a person's hand. A preferred embodiment of the present invention is a hand weight that may be described as j-shaped, asymmetrically v-shaped, and/or check-mark-shaped. Many features and/or advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

FIGS. 10*a*-10*g* show the weight of FIG. 1 being grasped in various ways in a person's hand;

DETAILED DESCRIPTION OF A PREFERRED EMBODIMENT

Figure 1:
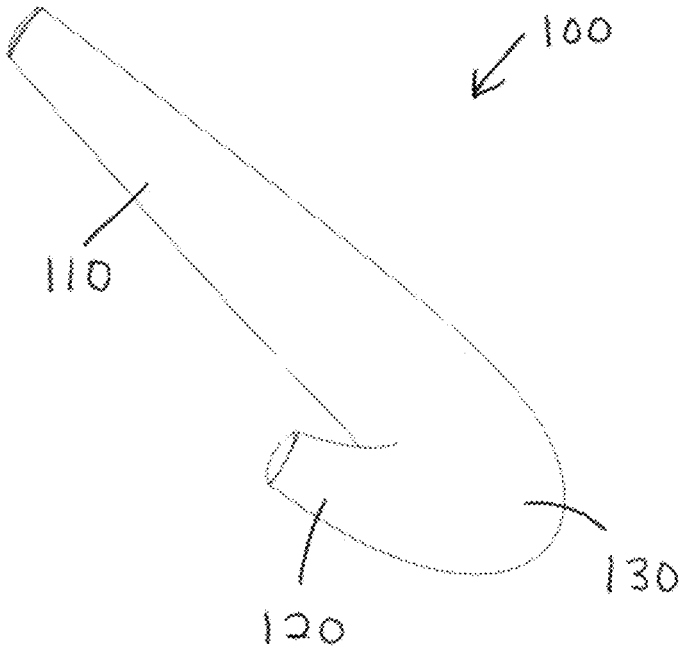
FIG. 1 is a perspective view of a first weight constructed according to the principles of the present invention.
Figure 2:
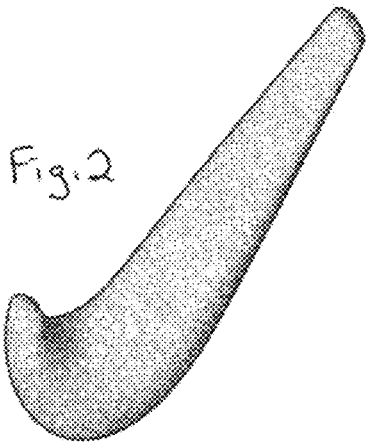
FIG. 2 is an alternative perspective view of the weight of FIG. 1.
Figure 7:
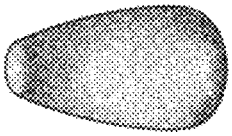
FIG. 7 is an opposite end view of the weight of FIG. 1.

FIGS. 1-9 show a weight 100 constructed according to the principles of the present invention. The weight 100 is preferably made of cast iron, covered with vinyl, and sized and configured to weigh 1.25 pounds and define a maximum linearly measured dimension (or length) of 6.25 inches. One alternative embodiment of the present invention is preferably scaled down to weigh 0.5 kilograms and define a maximum linearly measured dimension (or length) of 6 inches. Unless otherwise specified, all measurements are plus or minus 0.25 inches. In a broader sense, the weight 100 may be described as a hand-held weight that weighs between 1 and 1.5 pounds and defines a maximum linearly measured dimension of between 5 and 7 inches.

The weight 100 may be described in terms of a first segment 110, a second segment 120, and a juncture 130 of integral interconnection between the first segment 110 and the second segment 120. The girth or circumference of the weight 100 is relatively greater at the juncture 130, and each segment 110 and 120 decreases in girth as a function of distance from the juncture 130. The maximum height of the depicted weight 100 (measured parallel to line Q in FIG. 8) is 2.5 inches. The maximum width of the depicted weight 100 (depicted in FIGS. 4-7 and measured perpendicular to the length and the height) is 1.5 inches.

Figure 4:
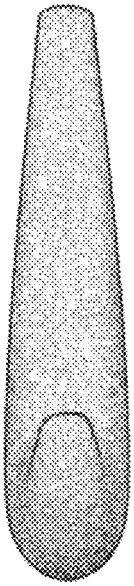
FIG. 4 is a side view of the weight of FIG. 1.
Figure 5:
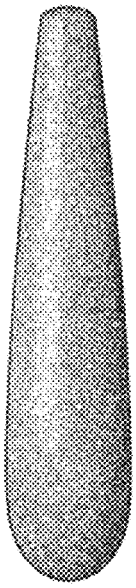
FIG. 5 is an opposite side view of the weight of FIG. 1.
Figure 6:
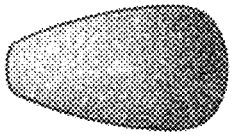
FIG. 6 is an end view of the weight of FIG. 1.
Figure 8:
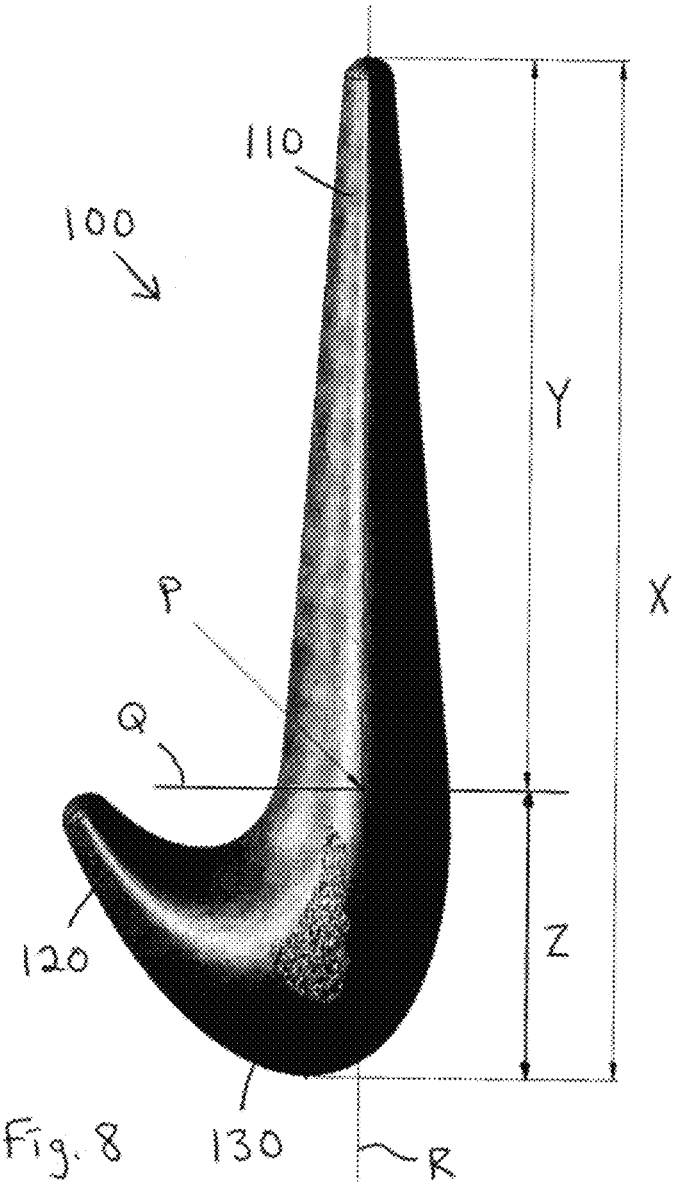
FIG. 8 is a front view of the weight of FIG. 1 with certain reference lines drawn relative thereto.

The weight 100 may be described as symmetrical relative to a plane of symmetry extending through the first segment and the second segment and containing the length of the weight 100 (parallel to the drawing sheet of FIG. 8 and perpendicular to the drawing sheet with reference to FIGS. 4 and 5). Also, the first segment 110 may be described as symmetrical in a manner that accommodate a similar fit in the person's hand when the weight is rotated 180 degrees about its length (see FIGS. 10*x* and 10*y*).

Over a longitudinally measured distance of 4.5 inches, the girth of the first segment 110 decreases from approximately 1.25 inches proximate the juncture 130 to approximately 0.25 inches proximate its distal end. The first segment 110 may be described as a cone-shaped member that tapers from the end proximate the juncture 130 to an opposite distal end. The first segment is sized and configured for grasping comfortably in a person's hand and thus, may also be described as a handle segment.

Over a distance of 1.6 inches, the girth of the second segment 120 decreases from approximately 1.25 inches proximate the juncture 130 to approximately 0.5 inches proximate its distal end. The second segment 120 may also be described as a tab or flange configured and arranged to alternatively (a) comfortably overlie a person's forefinger when the handle segment 110 is comfortably grasped in a first orientation by all four fingers (see FIGS. 10*a*-10*b*); (b) comfortably overlie outwardly facing skin extending between a person's thumb and forefinger when the handle segment 110 is comfortably grasped in a second orientation by at least the three fingers furthest from the person's thumb (see FIG. 10*c*); and (c) fit comfortably between a person's forefinger and middle finger when the handle segment 110 is comfortably grasped by the three fingers furthest from the thumb (see FIG. 10*g*).

One-half of the mass of the weight 100 occupies less than one-third of the length of the weight 100, including all of the juncture 130 (and all of the second segment 120 on the depicted embodiment 100), and the other one-half of the mass of the weight 100 occupies more than two-thirds of the length of the weight 100, including most of the first segment 110. More specifically, FIG. 8 shows a line Q that represents a plane passing orthogonally through the first segment 110 and dividing the weight 100 into half in terms of mass. X indicates the overall length of the weight 100 (6.25 inches); Y indicates the fractional length (4.5 inches) of the one-half of the mass of the weight 110 disposed on one side of Q; and Z indicates the fractional length (1.75 inches) of the one-half of the mass of the weight 110 disposed on an opposite side of Q. R is a longitudinal axis associated with the first member 110, and P is a point of intersection between R and Q.

The juncture 130 integrally joins the first segment 110 and the second segment 120 in a manner that defines both an acute interior angle or corner between the first segment 110 and the second segment 120, and an obtuse exterior angle or corner between the first segment 110 and the second segment 120. The interior angle (designated as G in FIG. 9) is preferably between 35 and 50 degrees, and is depicted as 40 degrees. The exterior angle (designated as H in FIG. 9) is preferably between 310 and 325 degrees, and is depicted as 320 degrees. A first fillet rounds the interior corner, and a second fillet rounds the exterior corner, and all surfaces of the weight 100 are curved. The juncture 130 has a girth of 2 inches, as measured along a line L bisecting the interior angle, and a maximum girth of 2.25 inches, as measured perpendicular to the line bisecting the interior angle (and as far "inboard" as possible while remaining clear of the first segment 110 and the second segment 120).

FIGS. 10*a*-10*g* show various ways in which the weight 100 may be comfortably held in a person's hand. For description purposes, the weight 100 in each of the FIGS. 10*a*-10*g* is further designated with a letter (e.g. "100a") to distinguish between the manners in which the weight 100 is positioned relative to the person's hand. Also, the person's hand H is described in terms of a thumb T, a forefinger F, and three other fingers, including a middle finger M, a ring finger, and a little finger.

Figure 10A:
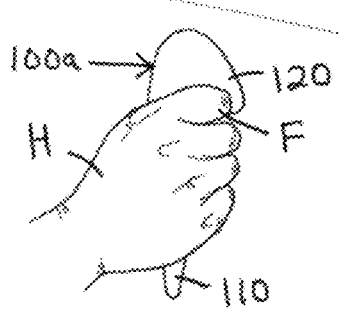
Figure 10B:
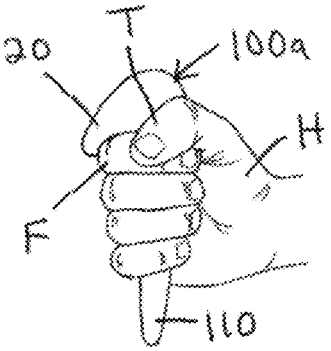

In FIGS. 10*a*-10*b*, the weight 100*a* is held comfortably in the person's hand H with the thumb T and all four fingers wrapped around the first segment 110 (like a closed fist), and with the second segment 120 comfortably overlying the person's forefinger F.

Figure 10C:
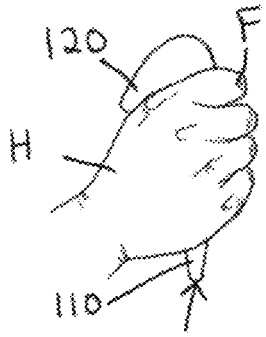

As compared to the weight 100*a* in FIGS. 10*a*-10*b*, the weight 100*c* in FIG. 10*c* is essentially rotated 180 degrees about the longitudinal axis of the first segment 110 relative to the person's hand H. In this regard, the weight 100*d* is held comfortably in the person's hand H with the thumb T and all four fingers wrapped around the first segment 110 (like a closed fist), and with the second segment 120 comfortably overlying outwardly facing skin extending between the person's thumb T and forefinger F.

As compared to the weight 100*c* in FIG. 10*c*, the handle segment 110 of the weight 100*d* in FIG. 10*d* is tilted to a less perpendicular orientation relative to the person's thumb T and fingers. In this regard, the weight 100*d* is held comfortably in the person's hand H with the thumb T and the forefinger F wrapped around the juncture 130, the other three fingers wrapped around the first segment 110 (more like a golf grip), and the second segment 120 comfortably overlying outwardly facing skin extending between the person's thumb T and forefinger F.

As compared to the weight 100*d* in FIG. 10*d*, the weight 100*e* in FIG. 10*e* is flipped to essentially reverse the positions of the first segment 110 and the second segment 120. In this regard, the weight 100*e* is held comfortably in the person's hand H with the thumb T and the forefinger F wrapped around the juncture 130, at least the middle finger M wrapped around the first segment 120, and the first segment 110 comfortably overlying outwardly facing skin extending between the person's thumb T and forefinger F.

The weight 100*f* in FIG. 10*f* occupies the same orientation relative to the person's hand H as the weight 100*a* in FIGS. 10*a*-10*b*. However, the person's thumb T is moved from a closed first position to a position comfortably overlying the curved end of the weight 100*f* (i.e. the exterior corner defined by the juncture 130).

As compared to the weight 100*a* in FIGS. 10*a*-10*b*, the weight 100*g* in FIG. 10*g* is moved down "one finger width" relative to the person's hand H. In this regard, the weight 100*g* is held comfortably in the person's hand H with the thumb T and the forefinger F wrapped around the juncture 130, the other three fingers wrapped around the first segment 110 (like a closed fist), and with the second segment 120 comfortably overlying the person's middle finger M (and comfortably underlying the person's forefinger F).

To arrive at yet another hand-hold on the weight 100, the ends of the weight 100*a* in FIGS. 10*a*-10*b* are essentially reversed in the person's hand H. In this arrangement (not shown), the weight 100 is held comfortably in the person's hand H with the thumb T and all four fingers wrapped around the first segment 110 (like a closed fist), and with the second segment 120 comfortably underlying the person's little finger.

Figure 11:
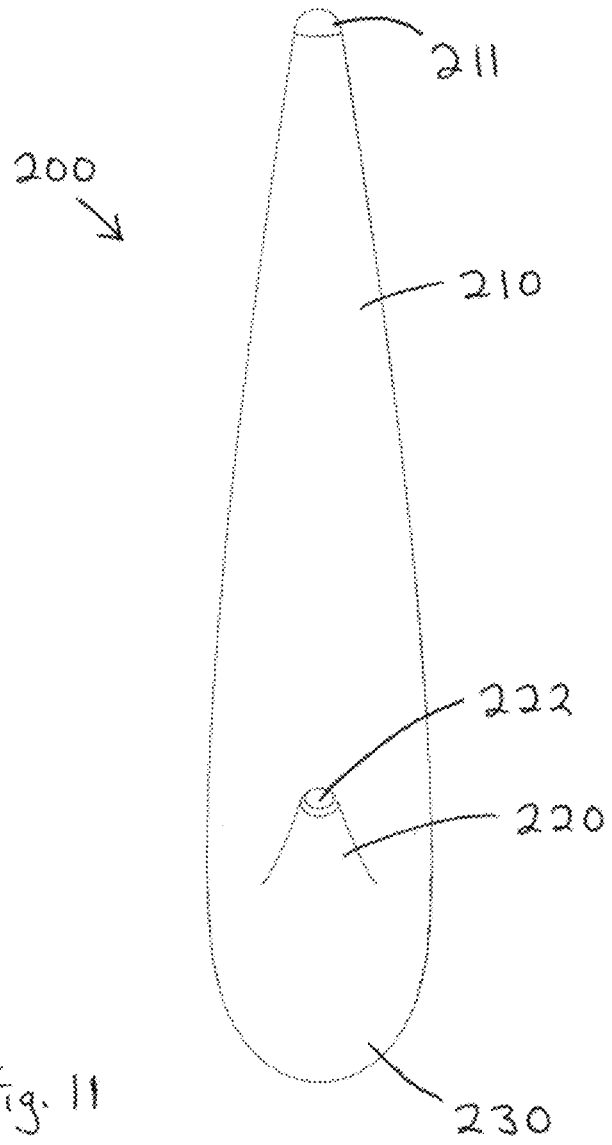
FIG. 11 is a side view of a second weight constructed according to the principles of the present invention and having the same front view as the weight of FIG. 1 (shown in FIGS. 3 and 8)
Figure 12:
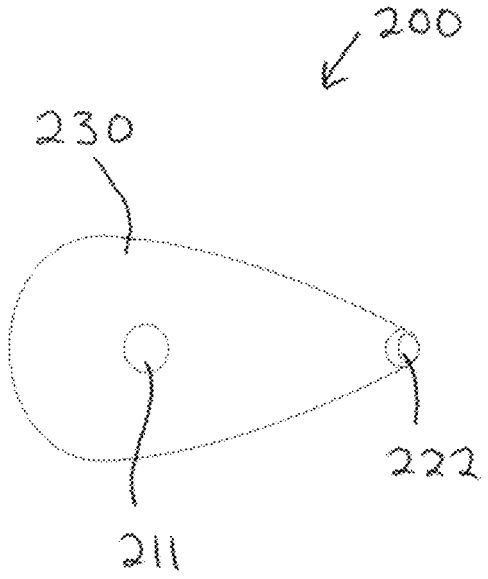
FIG. 12 is an end view of the weight of FIG. 11.
Figure 13:
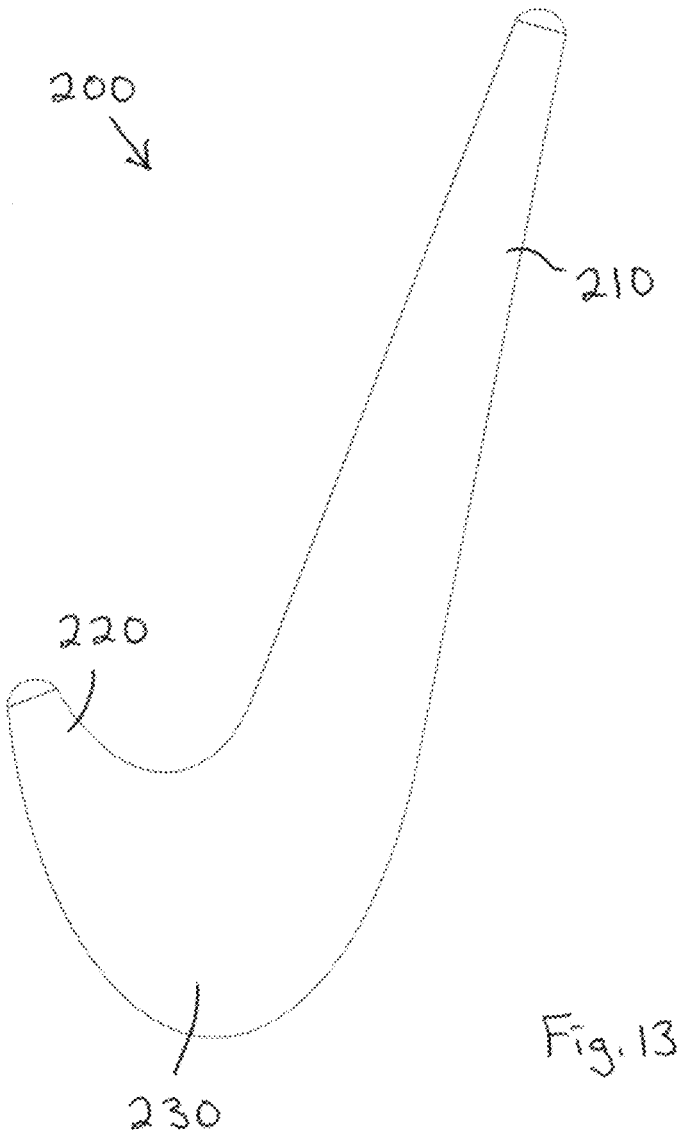
FIG. 13 is a re-oriented front view of the weight of FIG. 11.

FIGS. 11-13 show a second weight 200 constructed according to the principles of the present invention. The front and back views of the second weight 200 are identical to those of the first weight 100, so FIGS. 3 and 9 may also be described as front and back views, respectively, of the weight 200, and FIG. 13 may be described as a reoriented front view of the weights 100 and 200. Moreover, the second weight 200 is identical to the first weight 100 except as noted below, and may be held as shown in and described with reference to FIGS. 10*a*-10*g*. As compared to their counterparts on the first weight 100, the first segment 210 and the second segment 220 on the second weight 220 have respective cross-sections that are relatively more circular and relatively less elliptical. As a result, the juncture 230 is not quite the same as the juncture 130, and the second weight 200 weighs less than the first weight 100 when built to the same overall scale. For ease of reference, the respective distal ends 211 and 222 of the segments 210 and 220 are labeled in FIGS. 11-12.

Figure 14:
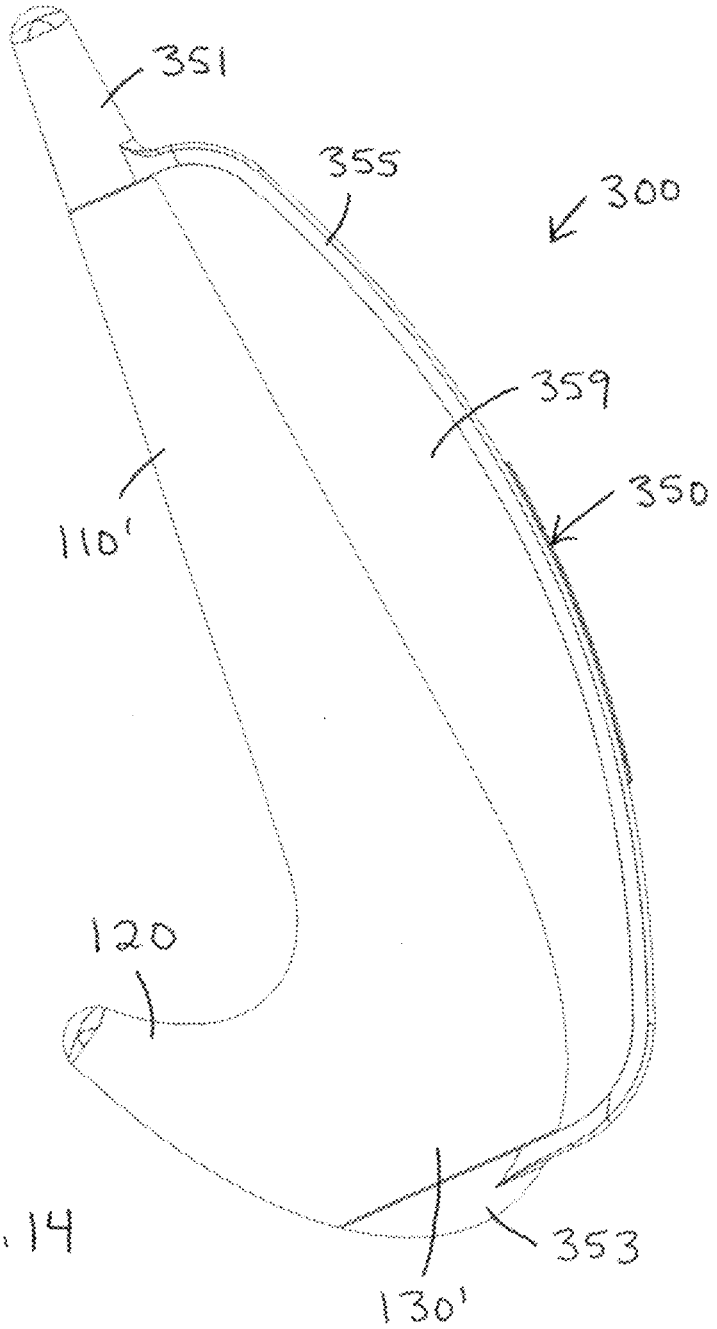
FIG. 14 is a front view of a third weight constructed according to the principles of the present invention.
Figure 15:
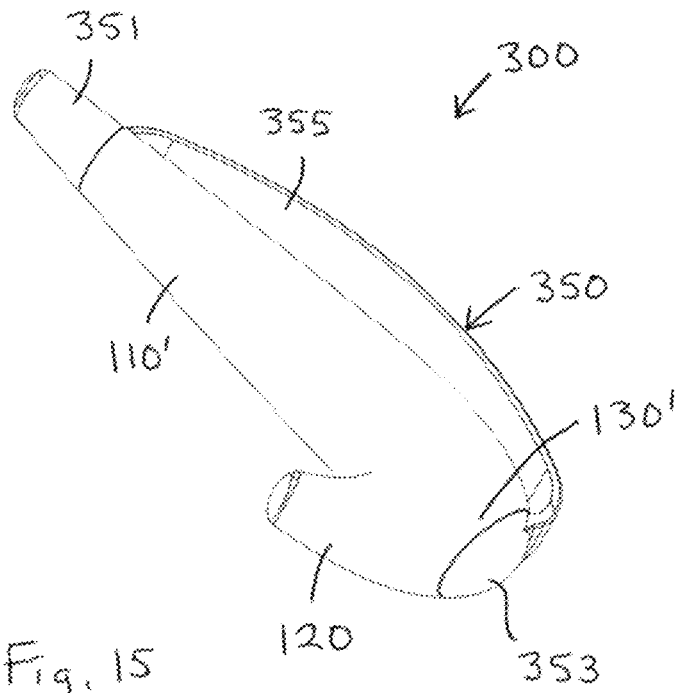
FIG. 15 is a perspective view of the weight of FIG. 14.

FIGS. 13-14 show a third weight 300 constructed according to the principles of the present invention. The third weight 300 is identical to the first weight 100 except as noted below. The first segment 110' is identical to the first segment 110 on the first weight 100, except that its distal end has been modified to receive and retain a first end 351 of a hand strap 350. The juncture 130' is identical to the juncture 130 on the first weight 100, except that its outside corner has been modified to receive and retain an opposite, second end 353 of a hand strap 350. The ends of the hand strap 350 are secured by conventional means, including physical fasteners, complementary snap fit features, sonic welding, overmolding, and/or adhesives. The hand strap 350 is preferably made of plastic or rubber and includes an intermediate portion 355 that extends between the ends 351 and 353 and cooperates with the first segment 110' to define a slot 359 sized and configured to receive a person's hand.

In one respect, the weights 100 and 200 may be described as j-shaped, and thus, the subject invention may be described and/or claimed in terms of a j-shaped exercise weight. In this respect, the term "j-shaped" is intended to mean shaped like many versions of the letter "j" without any separate tittle included. Representative examples include the lower case "j" in Microsoft Word fonts Comic Sans MS, Kristen ITC, and Segoe Print; the upper case "J" in Microsoft Word fonts Century Gothic, Euphemia, Maiandra Gb, Matisse ITC, Mistral, and Segoe Print; the weight 100 oriented as shown in FIGS. 3 and 8; and any and all variations that fall between these examples.

Figure 3:
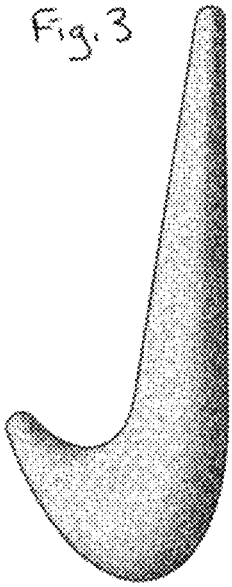
FIG. 3 is a front view of the weight of FIG. 1.
Figure 9:
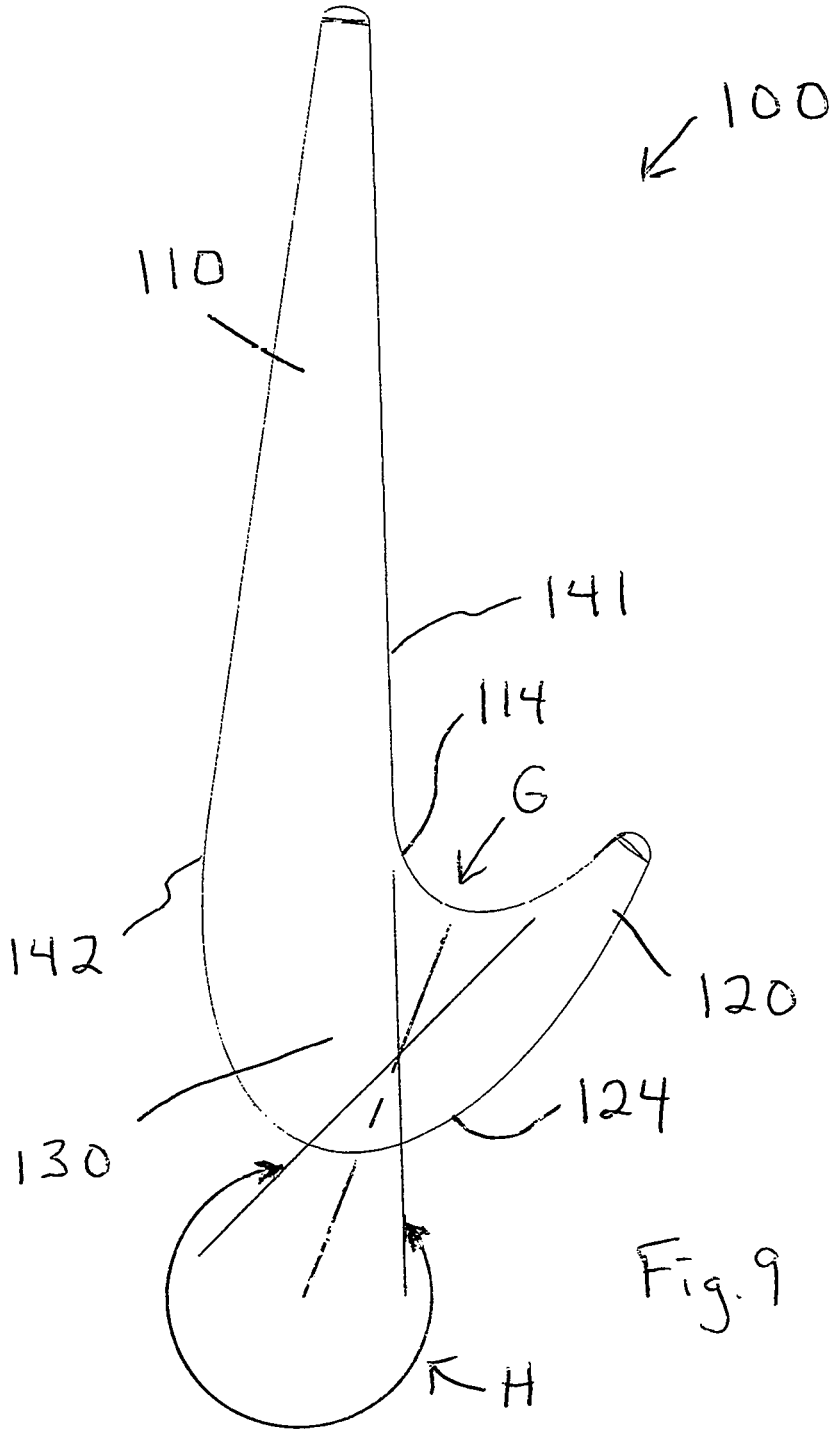
FIG. 9 is a back view of the weight of FIG. 1 with certain reference lines drawn relative thereto.

As shown in FIG. 9, which is a back view (and thus, a mirror image of the front view) of the weight 100, inwardly facing co-planar edges of the first segment 110, the second segment 120, and a respective rounded corner edge or curve 114 cooperate to form a first j-shaped edge designated as 141 (which appears as a reverse "j-shape" in FIG. 9 but nonetheless appears as a standard "j-shape" in FIGS. 3 and 8). Similarly, outwardly facing co-planar edges of the first segment 110, the second segment 120, and a respective rounded corner edge or curve 124 cooperate to form a relatively larger, second j-shaped edge designated as 142 (which appears as a reverse "j-shape" in FIG. 9 but nonetheless appears as a standard "j-shape" in FIGS. 3 and 8).

In another respect, the weights 100 and 200 may be described as substantially j-shaped, and thus, the subject invention may be described and/or claimed in terms of a substantially j-shaped exercise weight. In this respect, the term "substantially j-shaped" is intended to mean a shape that is recognizable in certain contexts as a stylized version of an upper case or lower case letter "j" (without any separate tittle included). For example, when informed that the weight 100 oriented as shown in FIG. 3 or 8 is representative of a letter of the English alphabet, most literate English speaking adults are likely to identify the image as the letter "j". Or, when the weight 100 oriented as shown in FIG. 3 or 8 is substituted for the letter "j" in a common English word or name that appears within the context of a phrase or title, a majority of literate English speaking adults are likely recognize the image as a stylized version of the letter "j". Examples include when the weight 100 oriented as shown in FIG. 3 or 8 is substituted for the letter "J" in the phrase "Join the Army" or for the letter "j" in the phrase "here comes the judge".

In another respect, the weights 100 and 200 may be described as check-mark-shaped, and thus, the subject invention may be described and/or claimed in terms of a check-mark-shaped exercise weight. In this respect, the term "check-mark-shaped" is intended to mean shaped like many variations of a check mark that is used to check off an item on a list. Representative samples include the check mark symbol in the Microsoft font Wingdings; the weight 200 oriented as shown in FIG. 13; and any and all variations that fall between these examples.

In another respect, the weights 100 and 200 may be described as asymmetrically v-shaped, and thus, the subject invention may be described and/or claimed in terms of an asymmetrically v-shaped exercise weight. In this respect, the term "asymmetrically v-shaped" is intended to mean shaped like a modified letter "v" where one leg of the "v" is significantly longer than the other. Representative examples, include combining one leg of a lower case "v" with an opposite side leg of an upper case "V" in Microsoft Word font Comic Sans MS or Segoe Print; the weight 200 oriented as shown in FIG. 13 (where the first segment or leg is at least twice as long as the second segment); and any and all variations that fall between these examples.

The present invention has been described with reference to preferred embodiments and methods of using the preferred embodiments with the understanding that this disclosure will enable persons skilled in the art to derive various modifications, improvements, and/or applications that nonetheless embody the essence of the subject invention. In view of the foregoing, the scope of the present invention is to be limited only to the extent of the following claims.

What is claimed is:

1. A hand-held exercise weight sized and configured to be held in a person's hand that includes a thumb, a forefinger, and three other fingers, comprising a mass of metal comprising a first segment, a second segment, and a juncture integrally interconnected therebetween, wherein the first segment is sized and configured to be grasped the person's hand with the person's thumb wrapped in a first direction about the first segment and the person's three other fingers wrapped in an opposite, second direction about the first segment, and the second segment is sized and configured to hook over a portion of the person's hand when the first segment is grasped, and the first segment and the juncture cooperate to define an overall length of the mass, and a plane extends perpendicular to the length and divides the mass into a first half that occupies less than one-third of the length, including all of the juncture, and a second half that occupiers more than two-thirds of the length, including a majority of the first segment.

2. The hand-held exercise weight of claim 1, wherein the first half includes all of the second segment.

3. The hand-held exercise weight of claim 1, wherein the first segment tapers from a larger cross-section proximate the juncture to a smaller cross-section proximate an opposite, distal end.

4. The hand-held exercise weight of claim 1, wherein the second segment tapers from a larger cross-section proximate the juncture to a smaller cross-section proximate an opposite, distal end.

5. The hand-held exercise weight of claim 1, wherein the weight defines a side-view profile bounded by inwardly facing co-planar edges of first j-shaped edge and bounded by outwardly facing co-planar edges of second j-shaped edge disposed beneath and rightward of the first j-shaped edge.

6. The hand-held exercise weight of claim 1, wherein the mass of metal is cast iron.

7. A hand-held exercise weight sized and configured to be held in a person's hand that includes a thumb, a forefinger, and three other fingers, comprising:

a first segment;

a second segment; and a juncture integrally joining the second segment to the first segment, wherein the first segment extends away from the juncture along a longitudinal axis and has an elliptical cross-sectional profile that extends perpendicular to the axis and tapers as a function of distance from the juncture, and the juncture defines a curved interior angle between the first segment and the second segment to accommodate a part of the person's hand between the first segment and the second segment when the first segment is grasped in the person's hand with the person's thumb wrapped in a first direction about the first segment and the person's three other fingers wrapped in an opposite, second direction about the first segment, wherein a plane extends perpendicular to the axis and intersects the first segment without intersecting the second segment and without intersecting the juncture, and respective first and second halves of equal mass are disposed on opposite first and second sides of the plane.

8. The hand-held exercise weight of claim 7, wherein the first segment and the juncture cooperate to define a length that is measured parallel to the axis, and the first of the halves spans more than two-thirds of the length and includes a majority of the first segment, and the second of the halves spans less than one-third of the length and includes all of the juncture.

9. The hand-held exercise weight of claim 8, wherein the second of the halves spans all of the second segment.

10. The hand-held exercise weight of claim 7, wherein the weight is cast iron.

11. The hand-held exercise weight of claim 7, wherein the weight is shaped like a lower case j.

* * * * *